US006040754A

United States Patent [19]

Kawanishi

[11] Patent Number: 6,040,754

[45] Date of Patent: Mar. 21, 2000

[54] THIN TYPE THERMAL FUSE AND MANUFACTURING METHOD THEREOF

[75] Inventor: Toshiro Kawanishi, Osaka, Japan

[73] Assignee: Uchihashi Estec Co., Ltd., Osaka, Japan

[21] Appl. No.: 09/258,255

[22] Filed: Feb. 26, 1999

[30] Foreign Application Priority Data

Jun. 11, 1998 [JP] Japan ..... 10-179675

[51] Int. Cl.[7] ..... H01H 85/046; H01H 85/044; H01H 69/02

[52] U.S. Cl. ..... 337/297; 337/231; 337/296; 337/404; 29/623

[58] Field of Search ..... 337/404, 159, 337/228, 290, 295, 296, 297, 405, 417, 227, 160, 231; 29/623

[56] References Cited

U.S. PATENT DOCUMENTS

| | | | |
|---|---|---|---|
| 3,805,208 | 4/1974 | McAlister | 337/228 |
| 4,272,753 | 6/1981 | Nicolay | 337/297 |
| 4,626,818 | 12/1986 | Hilgers | 337/166 |
| 4,873,506 | 10/1989 | Gurevich | 337/290 |
| 4,924,203 | 5/1990 | Gurevich | 337/231 |
| 5,097,247 | 3/1992 | Doerrwaechter | 337/405 |
| 5,099,219 | 3/1992 | Roberts | 337/297 |
| 5,140,295 | 8/1992 | Vermot-gaud et al. | 337/297 |
| 5,367,280 | 11/1994 | Thiel et al. | 337/297 |
| 5,453,726 | 9/1995 | Montgomery | 337/290 |
| 5,552,757 | 9/1996 | Blecha et al. | 337/297 |
| 5,572,181 | 11/1996 | Kiryu et al. | 337/273 |
| 5,621,375 | 4/1997 | Gurevich | 337/297 |
| 5,712,610 | 1/1998 | Takeichi et al. | 337/290 |

FOREIGN PATENT DOCUMENTS

| | | | |
|---|---|---|---|
| 356160648A | 12/1981 | Japan | G01N 27/12 |
| 357117255A | 7/1982 | Japan | H01L 21/88 |
| 357122565A | 7/1982 | Japan | H01L 27/10 |
| 401272133A | 10/1989 | Japan | H01L 21/82 |
| 401295440A | 11/1989 | Japan | H01L 21/82 |
| 402100221A | 4/1990 | Japan | H01H 37/76 |
| 404065046A | 3/1992 | Japan | H01H 85/048 |
| 404365351A | 12/1992 | Japan | H01L 21/82 |
| 408213216A | 8/1996 | Japan | H01C 13/00 |
| 409115418A | 5/1997 | Japan | H01H 85/06 |

*Primary Examiner*—Leo P. Picard
*Assistant Examiner*—Anatoly Vortman
*Attorney, Agent, or Firm*—Sughrue, Mion, Zinn, Macpeak & Seas, PLLC

[57] ABSTRACT

A thin type thermal fuse is structured by a resin base film, a pair of belt-shaped lead conductors, a low melting-point fusible alloy piece, flux and a resin cover film. Tip portions of the pair of belt-shaped lead conductors is fixed on the resin base film. The low melting-point fusible alloy piece is coupled between the tip end portions of the belt-shaped lead conductors. The flux applied on the low melting-point fusible alloy piece. The resin cover film which is disposed on a one surface of the resin base film so that a space between said films at peripheries of both the resin cover film and the resin base film is sealed and a space between the resin cover film and the belt-shaped lead conductors is sealed. In the thin type thermal fuse, a relation of $(V/L)^{1/2}/d \leqq 1.8$ is satisfied, where a distance between the tip portions of the belt-shaped lead conductors is set to be L, a volume of the low melting-point fusible alloy piece is set to be V and a distance between the front surface of the resin base film and an inner surface of the resin cover film is set to be d.

13 Claims, 8 Drawing Sheets

THIN TYPE THERMAL FUSE AND MANUFACTURING METHOD THEREOF

BACKGROUND OF THE INVENTION

1. Field of the Invention

The present invention relates to a thin type thermal fuse and a manufacturing method thereof, which is used for manufacturing a thermal fuse for protecting a lithium ion secondary battery from excessive discharge and excessive charge, for example.

2. Description of the Related Art

Recently, a large capacity battery such as a lithium ion secondary battery has been employed as a power source for a portable electric device.

In such a large capacity battery, a quite large current may flow therein at the time of charging and discharging and so abnormal heat may be generated due to the excessive charging or the failure of the main device.

In order to obviate such a problem, it has been investigated to employ a thermal fuse so that the fuse senses this abnormal heating thereby to disconnect the battery from a charging power source or to disconnect the battery from the main device.

Such a thermal fuse for protecting the battery is required to be a thin type. As a thin type thermal fuse, there has been known one which is arranged in the following manner. Tip portions of a pair of belt-shaped lead conductors are fixed on one surface of a resin base film. A low melting-point fusible alloy piece is coupled between the tip portions of the belt-shaped lead conductors. A resin cover film is disposed on the one surface of the resin base film. The space between the films at the peripheries of both the resin films is sealed by an adhesive and also the space between the resin cover film and the belt-shaped lead conductors is sealed by an adhesive.

However, the aforesaid thin type thermal fuse becomes likely inoperative by the following reasons, for example. That is, the ratio (surface area/sectional area) of the belt-shaped lead conductor is quite larger than that of a circular lead conductor. An amount of dissipation heat is too large at the time of connecting the low melting-point fusible alloy piece to the lead conductor by the welding. The defective welding connection is likely occurred. This welded connection is in a state that the alloy piece is connected to the lead conductor in a point-fashion at the one portion of melted metal being spread and remaining portions of the melted metal merely contact to the conductors, and so it is difficult to detect the defective welding even by measuring the resistance value. In an alloy type thermal fuse, the low melting-point fusible alloy piece being fused becomes spherical due to the surface tension and then separated into several pieces. On the other hand, in the aforesaid thin type thermal fuse, since the melted alloy contacts in a circular plate fashion to the inner wall of the thin space, the surface area of the melted alloy on which the surface tension acts is small. Accordingly, the separation function of the alloy piece being fused is essentially degraded as compared with that of the aforesaid spherical shape of the alloy piece being fused of the alloy type thermal fuse.

SUMMARY OF THE INVENTION

It is an object of the present invention to provide a thin type thermal fuse which can be easily manufactured, a thin type thermal fuse capable of ensuring good operability, and a manufacturing method thereof.

A thin type thermal fuse according to the present invention is comprised of: a resin base film; a pair of belt-shaped lead conductors, tip portions of the pair of belt-shaped lead conductors being fixed on the resin base film; a low melting-point fusible alloy piece coupled between the tip end portions of the belt-shaped lead conductors; flux applied on the low melting-point fusible alloy piece; a resin cover film which is disposed on a one surface of the resin base film so that a space between said films at peripheries of both the resin cover film and the resin base film is sealed and a space between the resin cover film and the belt-shaped lead conductors is sealed; wherein a relation of $(V/L)^{1/2}/d \leqq 1.8$ is satisfied, where a distance between the tip portions of the belt-shaped lead conductors is set to be L, a volume of the low melting-point fusible alloy piece is set to be V and a distance between the front surface of the resin base film and an inner surface of the resin cover film is set to be d.

A method of manufacturing a thin type thermal fuse according to the present invention comprises the steps of: fixing tip portions of a pair of belt-shaped lead conductors on a resin base film; coupling a low melting-point fusible alloy piece between the tip end portions of the belt-shaped lead conductors; applying flux on the low melting-point fusible alloy piece; disposing a resin cover film on a one surface of the resin base film so that a space between said films at peripheries of both the resin cover film and the resin base film is sealed and a space between the resin cover film and the belt-shaped lead conductors is sealed; wherein a relation of $(V/L)^{1/2}/d \leqq 1.8$ is satisfied, where a distance between the tip portions of the belt-shaped lead conductors is set to be L, a volume of the low melting-point fusible alloy piece is set to be V and a distance between the front surface of the resin base film and an inner surface of the resin cover film is set to be d.

PREFERRED EMBODIMENTS OF THE INVENTION

Embodiments of the present invention will be described with reference to the accompanying drawings.

Figure 1A:
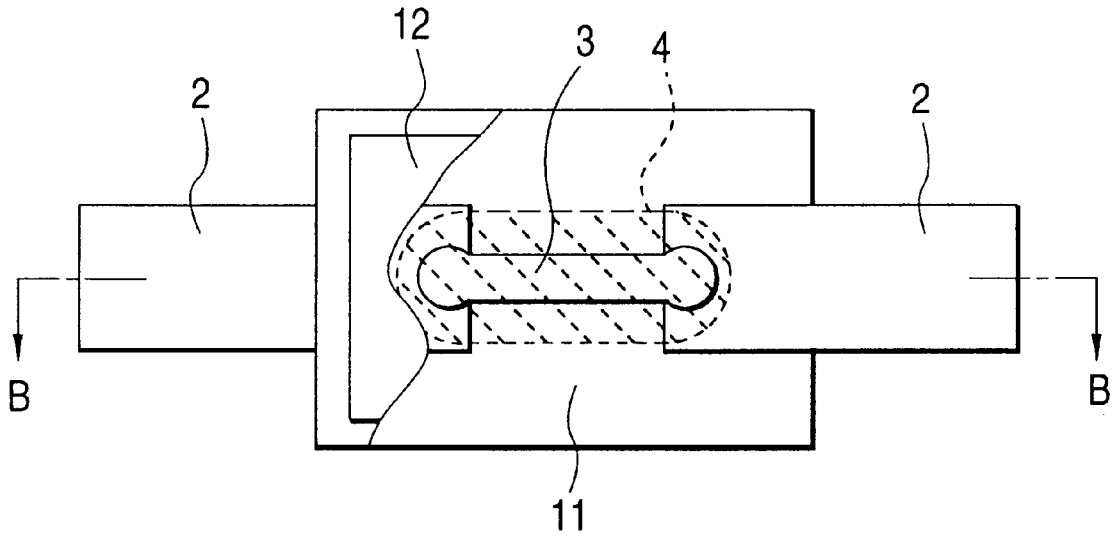
FIG. 1A is a diagram showing an embodiment of a thin type thermal fuse according to a first embodiment.
Figure 1B:
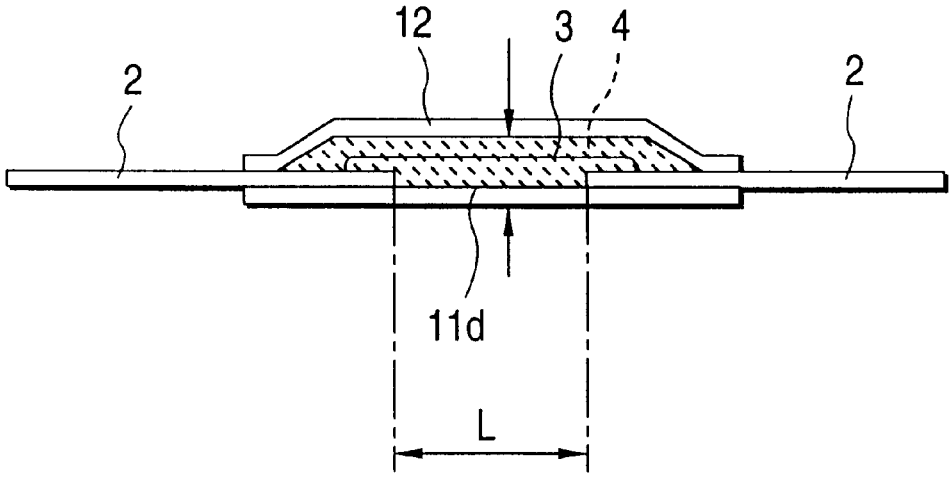
FIG. 1B is a sectional view of FIG. 1A taken along B—B line in FIG. 1A.

FIG. 1A shows a thin type thermal fuse according to a first embodiment of the present invention, FIG. 1B is a sectional view taken along a line B—B in FIG. 1A.

In FIG. 1, reference numeral 11 denotes a resin base film; and 2, belt-shaped lead conductors each having a tip portion fixed to the resin base film 11 by the thermal fusing or an adhesive. Reference numeral 3 denotes a low melting-point fusible alloy piece coupled between the tip portions of the belt-shaped lead conductors 2, 2by the welding; 4, a flux coated on the low melting-point fusible alloy piece; and 12, a resin cover film disposed on the one surface of the resin base film 11 such that the space between the films at the peripheries of the resin cover film and the space between the resin cover film and the belt-shaped lead conductors are sealed.

As the flux, an activated rosin is generally used, and the activated rosin to which an activating agent for strengthening activation is used. As the rosin, there are a natural rosin, a modified rosin such as a water-added rosin, an inhomogeneous rosin and a polymerized rosin, and a purified rosin thereof. As the activating agent, hydrochloride of diethylamine, hydrobromide of diethylamine and the like can be used. Wax is sometime mixed with the flux to adjust the melting point of the flux.

In the aforesaid arrangement, supposing that the distance between the tip portions of the belt-shaped lead conductors is L, the volume of the low melting-point fusible alloy piece is V and the distance between the one surface of the resin base film and the inner surface of the resin cover film is d, there is a following relation among these values.

$$(V/L)^{1/2}/d \leqq 1.8$$

The low melting-point fusible alloy piece 3 is formed by a round wire or a strap or flat wire made of low melting-point fusible alloy whose melting point is adjusted in accordance with the operation temperature. The diameter of the round wire is usually set in a range of 500 $\mu$m to 100 $\mu$m. The flat wire employed is set to have the same cross area as that of the round wire. Namely, the cross area of the wire is from about 0.78 to 3.2 $mm^2$.

The belt-shaped lead conductor 2 may be made of copper, aluminum, nickel or the like, for example. The belt-shaped lead conductor usually may have a thickness in a range of 50 $\mu$m to 200 $\mu$m, preferably about 100 $\mu$m, and have a width in a range of 2 mm to 5 mm, preferably about 3 mm. The length of the belt-shaped lead conductor is generally in the range of 4 to 31 mm, preferably 9 to 23 mm.

The resin base film 11 and the resin cover film 12 may be formed of engineering plastics such as polyethylene terephthalate, polyamide, polyimide, polybutylene terephthalate, polyphenylene oxide, polyethylene sulfide, polysulfone, or the like. Usually, the same kind of film is employed for the resin base film and the resin cover film, but different kinds of films may be employed for these films. The thickness of each of these films is set in a range of 50 $\mu$m to 500 $\mu$m. The length of the resin base film 11 is generally in the range of 7 to 18 mm, preferably 7 to 12 mm. The width is generally in the range of 2.5 to 10 mm, preferably, 3 to 7 mm.

In the case of manufacturing the thin type thermal fuse shown in FIG. 1, the tip portions of the pair of the belt-shaped lead conductors 2, 2 are fixed on the one surface of the resin base film 11 by the thermal pressing, ultrasonic fusing, adhesive or the like. Then, the low melting-point fusible alloy piece 3 is connected to the tip portions of the belt-shaped lead conductors 2, 2 by the resistor welding or the like so that the tip portions thereof are coupled by the low melting-point fusible alloy piece.

This welding is performed in a manner that about 2 to 30% of the entire surface area of the low melting-point fusible alloy piece serves as the contact surface. Thus, the exposed surface area of the belt-shaped lead conductors (the surface area of the tip portions of the belt-shaped lead conductors except for the sealed portions thereof) is not less than about 2 to 30% of the entire surface area of the low melting-point fusible alloy piece.

Further, the flux 4 is coated and solidified over the low melting-point fusible alloy piece 3 with a predetermined thickness d. The thickness d of the flux is set to satisfy the aforesaid relation of $(V/L)^{1/2}/d \leqq 1.8$.

Then, the resin cover film 12 is disposed on the one surface of the resin base film 11. Thereafter, in the state that the resin cover film 12 is made contact to the flux, the resin base film 11 is coupled to the resin cover film 12 and also the resin cover film 12 is coupled to the non-sealed portions 20 of the belt-shaped lead conductors by means of the heat sealing, ultrasonic fusing, laser radiation, or the like. Thus, the fabrication of the thin type thermal fuse shown in FIG. 1 is completed.

Table 1 exhibits the experimental result which was obtained by using the following samples. The number of samples for each case is 10. The samples were dipped into the heated oil of 95° C. for two minutes and the samples having not resulted in non-conductive state were determined to be inoperative. Each of the samples was formed in a manner that a round line with a diameter of 550 $\mu$m and a melting point of 93° C. was employed as the low melting-point fusible alloy piece 3. Rosin was used as the flux 4. The values L and V were changed (the value V was changed by changing the length of the low melting-point fusible alloy piece). The belt-shaped lead conductors (formed by using belt-shaped copper with a thickness of 0.1 mm and a width of 4 mm) and the low melting-point fusible alloy pieces were coupled by the welding particularly in a state where the surface of the belt-shaped lead conductors was slightly oxidized to forcedly place in an insufficient state.

TABLE 1

| Distance between tip portions of belt-shaped lead conductors L (mm) | Volume of low melting-point fusible alloy piece V ($mm^3$) | Space between resin films d (mm) | $(V/L)^{1/2}/d$ | Inoperable sample Ratio (%) |
|---|---|---|---|---|
| 4.5 | 2.252 | 0.40 | 1.77 | 0 |
| 4.5 | 2.252 | 0.38 | 1.86 | 40 |
| 4.5 | 2.542 | 0.40 | 1.87 | 30 |
| 7.0 | 2.217 | 0.33 | 1.70 | 0 |
| 7.0 | 2.217 | 0.30 | 1.87 | 20 |
| 7.0 | 2.545 | 0.33 | 1.82 | 10 |

As apparent from this experimental result, the condition of $(V/L)^{1/2}/d=1.8$ is a critical point for determining whether or not the sample is inoperative. That is, it will be understood that, with reference to the critical point, as the distance L between the tip portions of the belt-shaped lead conductors becomes longer, as the volume of the low melting-point fusible alloy piece becomes smaller, or as the space d becomes larger, the low melting-point fusible alloy piece will be more likely melted. As a result, the inoperable sample ratio decreases (the validity as to that the V/L relates to √thereof will be supported from the dimension of d).

In the manufacturing method of the thin type thermal fuse according to the first embodiment of the present invention, by merely restricting the thickness d of the flux 4 covering the low melting-point fusible alloy piece 3 and then by normally coupling the resin base film 11 with the resin cover film 12 and coupling the resin cover film 12 with the belt-shaped lead conductors, the thin type thermal fuse satisfying the aforesaid condition of $(V/L)^{1/2}/d \leqq 1.8$ can be manufactured. Accordingly, the thin type thermal fuse capable of making the generation ratio of inoperability zero can be easily manufactured.

Figure 2A:
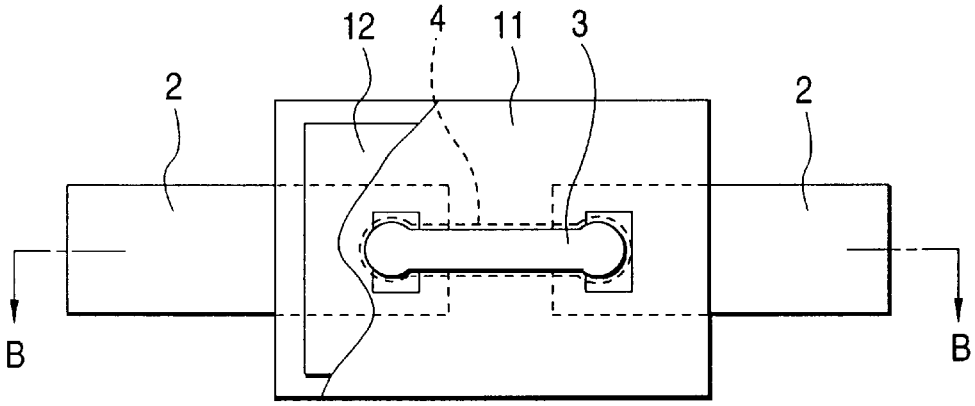
FIG. 2A is a diagram showing an embodiment of a thin type thermal fuse according to a second embodiment.
Figure 2B:
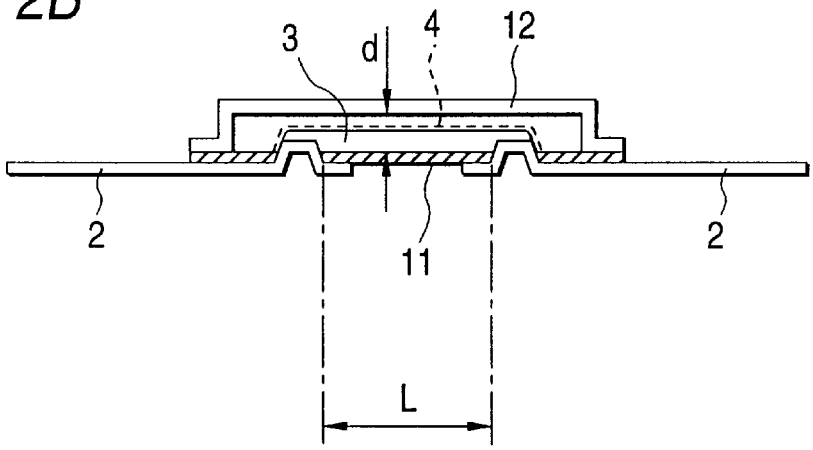
FIG. 2B is a sectional view of FIG. 2A taken along B—B line in FIG. 2A.

FIG. 2A shows a thin type thermal fuse according to a second embodiment of the present invention. FIG. 2B is a sectional view taken along a line B—B.

Figure 3:
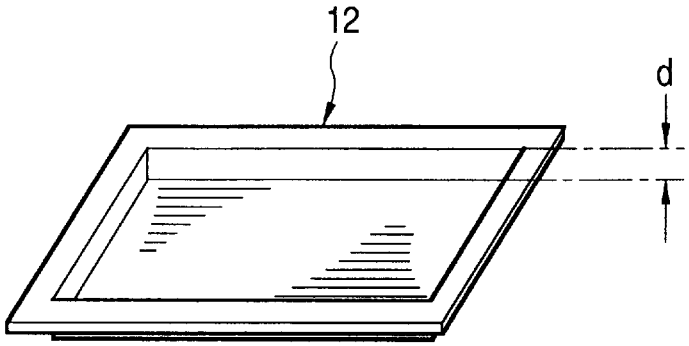
FIG. 3 is a diagram showing a resin cover film used in the thin type thermal fuse according to the second embodiment.

FIG. 3 shows the resin cover film 12 used in the thin type thermal fuse. The resin cover film is formed in a flat-case shape satisfying the relation of $(V/L)^{1/2}/d \leqq 1.8$.

The thin type thermal fuse according to the second embodiment is manufactured in the following manner. Namely, the tip portions of the pair of the belt-shaped lead conductors 2, 2 are exposed from the rear surface side of the resin base film 11 to the main surface side thereof, and then, it is fixed on the main surface by the thermal pressing, or the like. The low melting-point fusible alloy piece 3 is connected to the tip portions of the belt-shaped lead conductors 2, 2 by the resistor welding or the like so that the tip portions thereof are coupled by the low melting-point fusible alloy piece. The flux 4 is coated on the low melting-point fusible alloy piece 3. The resin cover film 12 having been formed in advance is disposed on the one surface of the resin base film 11. The resin base film 11 is coupled to the peripheral portions of the resin cover film 12 and also the peripheral portions of the resin cover film 12 are coupled to the belt-shaped lead conductors 2 by means of the heat sealing, ultrasonic fusing, laser radiation, or the like. As a result, the manufacturing of the thin type thermal fuse is completed.

Figure 4A:
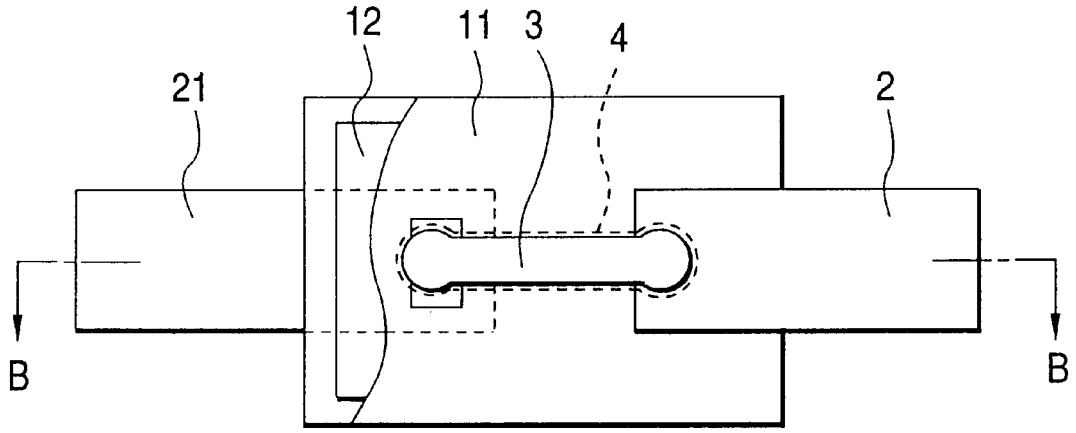
FIG. 4A is a diagram showing an example of a thin type thermal fuse according to a third embodiment.
Figure 4B:
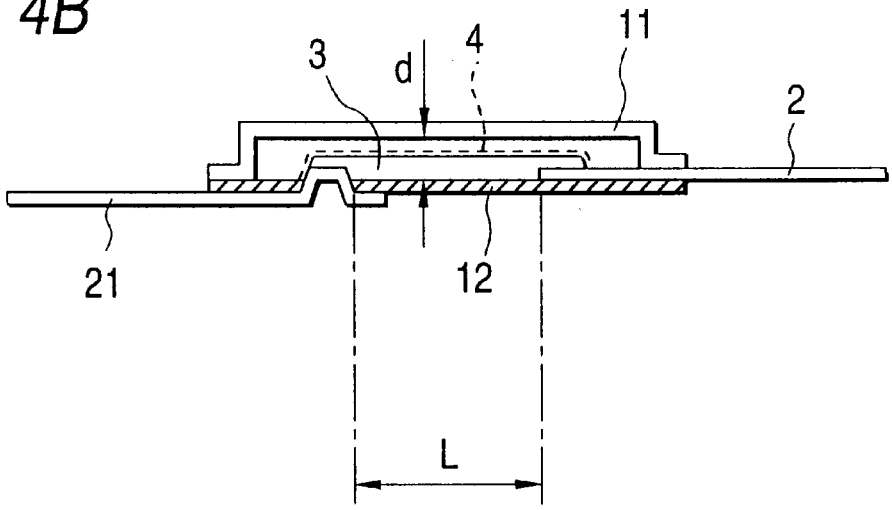
FIG. 4B is a sectional view of FIG. 4A taken along B—B line in FIG. 4A.

FIG. 4A is a thin type thermal fuse according to a third embodiment of the present invention. FIG. 4B is a sectional view taken along a line B—B in FIG. 4A. This thin type thermal fuse also employs the cover film 12 formed by resin shown in FIG. 3.

The thin type thermal fuse according to the third embodiment as shown in FIG. 4 is manufactured in the following manner. The tip portion of one belt-shaped lead conductor 21 is exposed from the rear surface side of the resin base film 11 to the main surface side thereof and then fixed on the main surface by the thermal pressing, or the like. The tip portion of the other belt-shaped lead conductor 2 is fixed on the main surface of the resin base film 11 by the thermal pressing, or the like. The low melting-point fusible alloy piece 3 is connected to the tip portions of the belt-shaped lead conductors 2, 21 by the resistor welding or the like so that the tip portions thereof are coupled by the low melting-point fusible alloy piece. The flux 4 is coated on the low melting-point fusible alloy piece 3. The resin cover film 12 having been formed in advance is disposed on the one surface of the resin base film 11. Then, the resin base film 11 is coupled to the peripheral portions of the resin cover film 12 and also the resin cover film 12 is coupled to the other belt-shaped lead conductor 2 by the heat sealing, ultrasonic fusing, laser radiation, or the like, whereby the fabrication of the thin type thermal fuse according to third embodiment is completed.

In each of the thin type thermal fuses according to the second and third embodiments, since the distance between the surface of the resin base film and the inner surface of the resin cover film is set by the depth d (the value d satisfying the condition of $(V/L)^{1/2}/d \leqq 1.8$) of the concave portion of the resin cover film having been formed in advance, the thin type thermal fuse satisfying the condition of $(V/L)^{1/2}/d \leqq 1.8$ can be easily manufactured by the normal manufacturing process.

The thin type thermal fuse according to the present invention can be used in order to protect, for example, a lithium ion secondary battery from abnormal heating.

Figure 5:
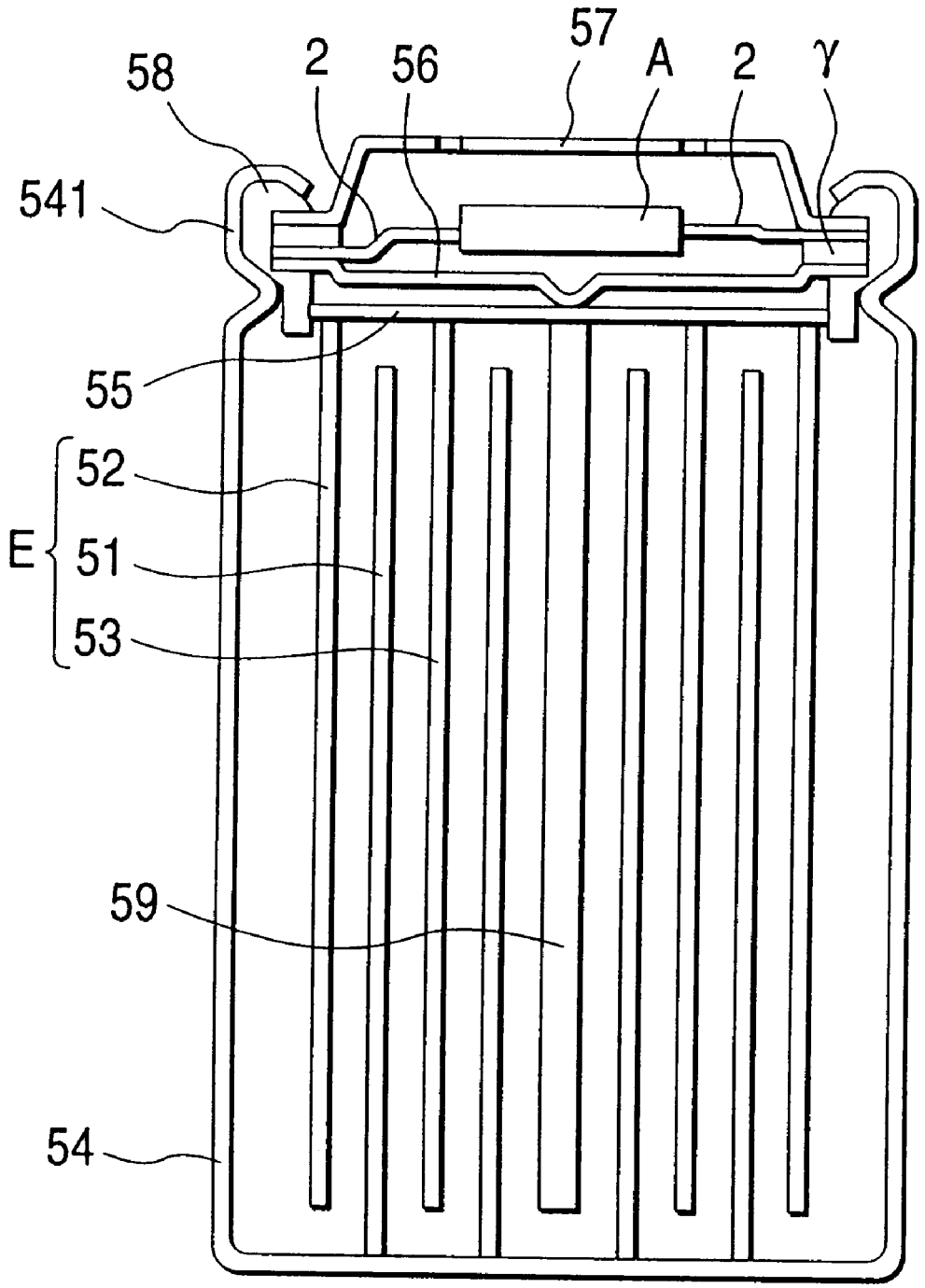
FIG. 5 is a diagram showing an example of the using state of a thin type thermal fuse according to the present invention.

FIG. 5 shows a lithium ion secondary battery which is arranged in the following manner. That is, a plurality of spirally-wound low melting-point fusible alloy pieces E each formed by a positive electrode 52, a negative electrode 53 and a separator 51 disposed between the positive and negative electrodes are housed within a negative electrode can 54 so that the negative electrode 53 is made electrically conductive with the bottom wall of the negative electrode can 54. A positive collecting electrode 55 is disposed at the top end within the negative electrode can 54 so that the positive electrode 52 is made electrically conductive with the positive collecting electrode 55. A top end portion 541 of the negative electrode can 54 is clamped at the outer peripheral end of an explosion-proof valve plate 56 and the outer peripheral end of a positive electrode lid 57 through a packing 58. As a result, the center concave portion of the explosion-proof valve plate 56 is made electrically conductive with a positive collecting electrode 59. The thin type thermal fuse manufactured according to the above embodiments can be used in the following manner. That is, the thin type thermal fuse is disposed in the space between the explosion-proof valve plate 56 and the positive electrode lid 57 of the lithium ion secondary battery. An insulation spacer ring r is disposed between the outer peripheral end of the explosion-proof valve plate 56 and the outer peripheral end of the positive electrode lid 57. One of the belt-shaped lead conductors 2 is sandwiched between the outer peripheral end of the explosion-proof valve plate 56 and the insulation spacer ring r, and the other of the belt-shaped lead conductors 2 is sandwiched between the outer peripheral end of the positive electrode lid 57 and the insulation spacer ring r, whereby the thin type thermal fuse is incorporated within the battery in series.

Figure 6A:
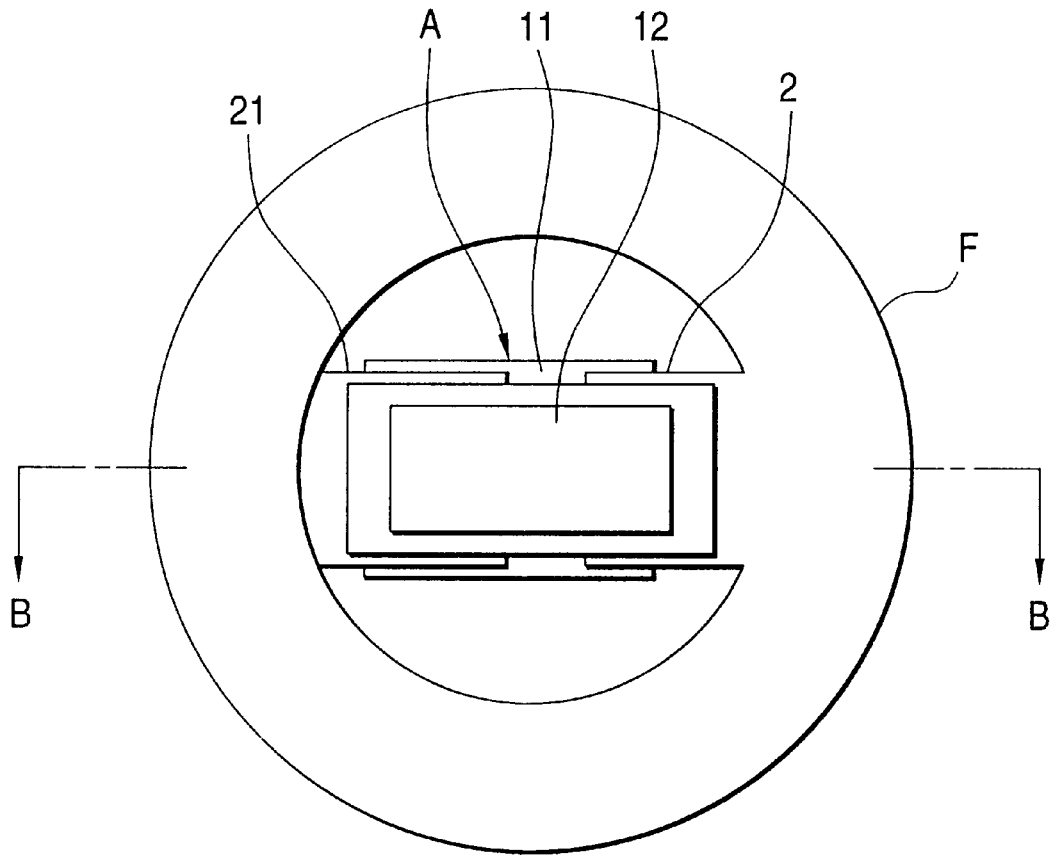
FIG. 6A is a diagram showing a modified embodiment of the thin type thermal fuse according to the second embodiment.
Figure 6B:
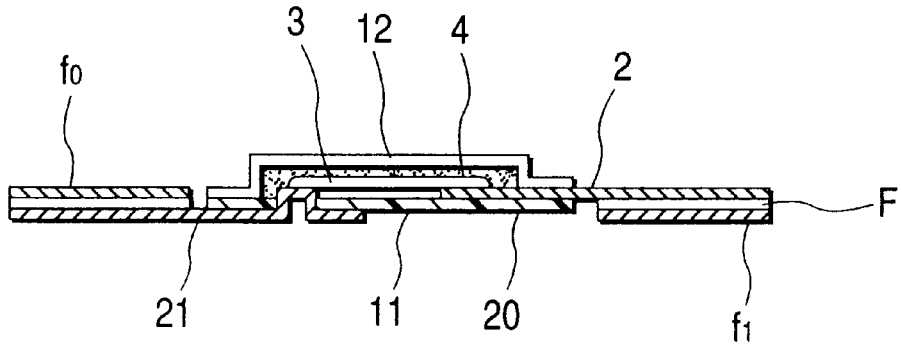
FIG. 6B is a sectional view of FIG. 6A taken along B—B line in FIG. 6A.

FIG. 6A shows a thin type thermal fuse of a modification of the third embodiment. FIG. 6Bis a sectional view taken along a line B—B in FIG. 6A. This thin type thermal fuse also can be used by being incorporated in series within the battery in the similar manner as described above.

Figure 7A:
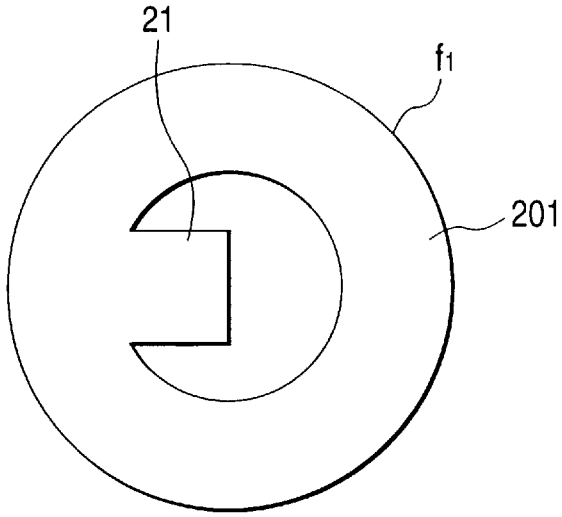
FIGS. 7A to 7C are diagrams showing frames used in another modified embodiment of the thin type thermal fuse according to the second embodiment.
Figure 7B:
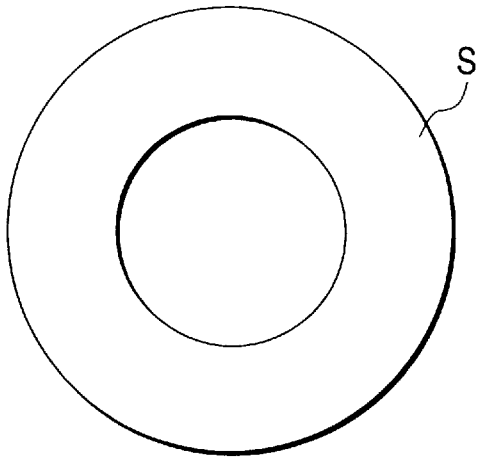
Figure 7C:
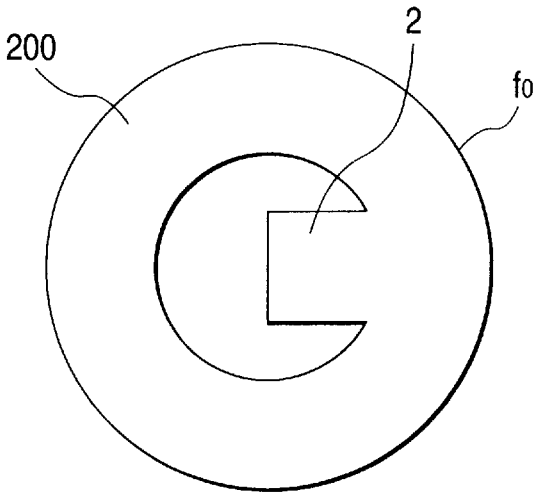
Figure 8A:
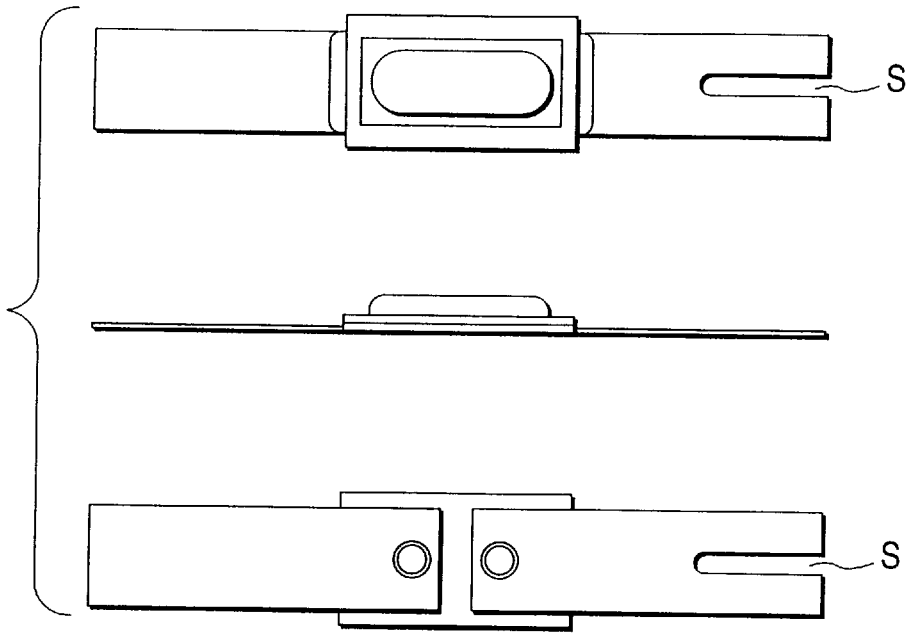
FIGS. 8 and 8B are diagrams showing still another modified embodiment of a thin type thermal fuse according to the second embodiment.
Figure 8B:
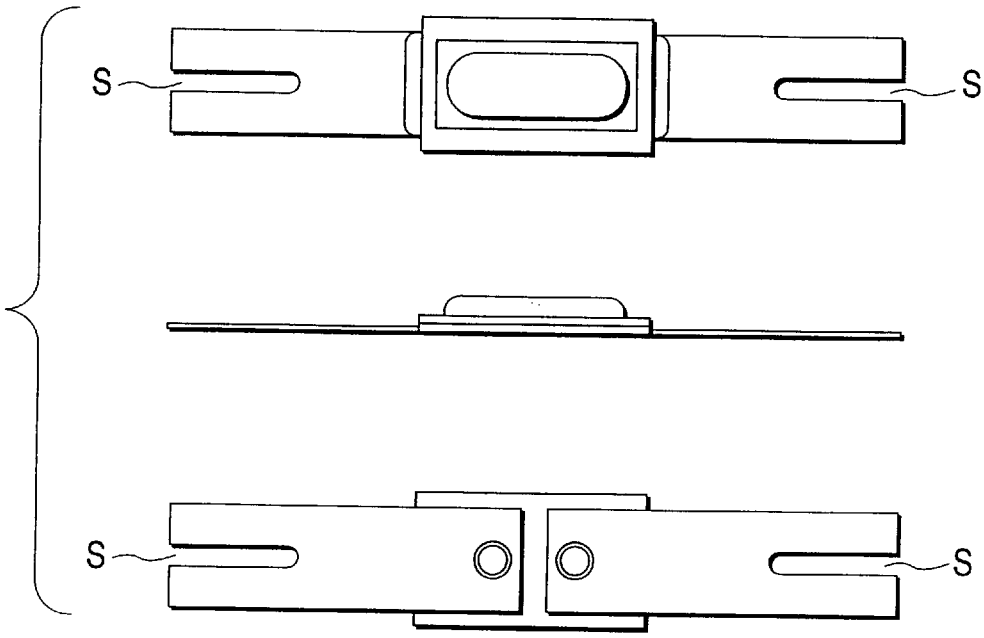

In FIGS. 6A and 6B, a symbol F represents a frame wherein a film electrode f1 having one belt-shaped lead conductor 21 at the inner periphery of an annular portion 201 shown in FIG. 7A, an annular resin spacer film s shown in FIG. 3B, and a film electrode f0 having the other belt-shaped lead conductor 2 at the inner periphery of an annular portion 200 shown in FIG. 7C are superimposed in a manner that the belt-shaped lead conductors 2, 21 are opposed with an angle of 180° therebetween. A hole a is formed at a sealed portion 20 of the lead conductor 2 of these two belt-shaped lead conductors 2, 21. These film electrodes f1, f0 may be combined with the surface of the resin spacer film s by the thermal fusing, or the like.

In FIG. 6A, a symbol A represents a thermal fuse body disposed in the center portion of the space of the frame F. This thermal fuse body is formed in the following manner. That is, the tip portion of the one belt-shaped lead conductor 21 is fixed on the one surface of the resin base film 11 and further locally exposed from the one surface of the resin base film 11 to the other surface thereof. The tip portion of the other belt-shaped lead conductor 2 is fixed on the other surface of the resin base film 11. The tip portion of the other belt-shaped lead conductor is coupled to the locally exposed tip portion of the one belt-shaped lead conductor 21 through the low melting-point fusible alloy piece 3 by the welding or the like so that the tip portions thereof are coupled by the low melting-point fusible alloy piece. Further, the flux 4 is coated on the low melting-point fusible alloy piece 3. Then, the resin cover film 12 shown in FIG. 3 is disposed on the flux-coated low melting-point fusible alloy piece. Thereafter, the resin base film 11 at the periphery of the resin cover film 12 is coupled to the resin cover film 12 and also the resin cover film 12 is coupled to the other belt-shaped lead conductor 2 by means of the heat sealing, ultrasonic fusing, laser radiation, or the like.

According to the thus arranged thin type thermal fuse, the thin type thermal fuse is sandwiched in the battery shown in FIG. 5 between the outer peripheral end of the explosion-proof valve plate 56 and the outer peripheral end of the positive electrode lid 57 without disposing the spacer ring r therebetween, and the thin type thermal fuse is electrically connected in series to the battery through a path from the electrical contact between the explosion-proof valve plate 56 and the film electrode f1 of the frame F→the belt-shaped lead conductor 21 of the film electrode f1→the low melting-point fusible alloy piece 3→the belt-shaped lead conductor 2 of the film electrode f0→the electrical contact between the positive electrode lid 57 and the film electrode f0 of the frame F.

The thin type thermal fuse according to the present invention may also be used in the following manner. That is, the one belt-shaped lead conductor and the thermal fuse body are closely contacted to the negative electrode can of the battery, then the one belt-shaped lead conductor is electrically connected to the negative electrode can, and the other belt-shaped lead conductor is electrically insulated from the negative electrode can by separating the other belt-shaped lead conductor from the negative electrode can or disposing an insulation film therebetween.

Figure 9A:
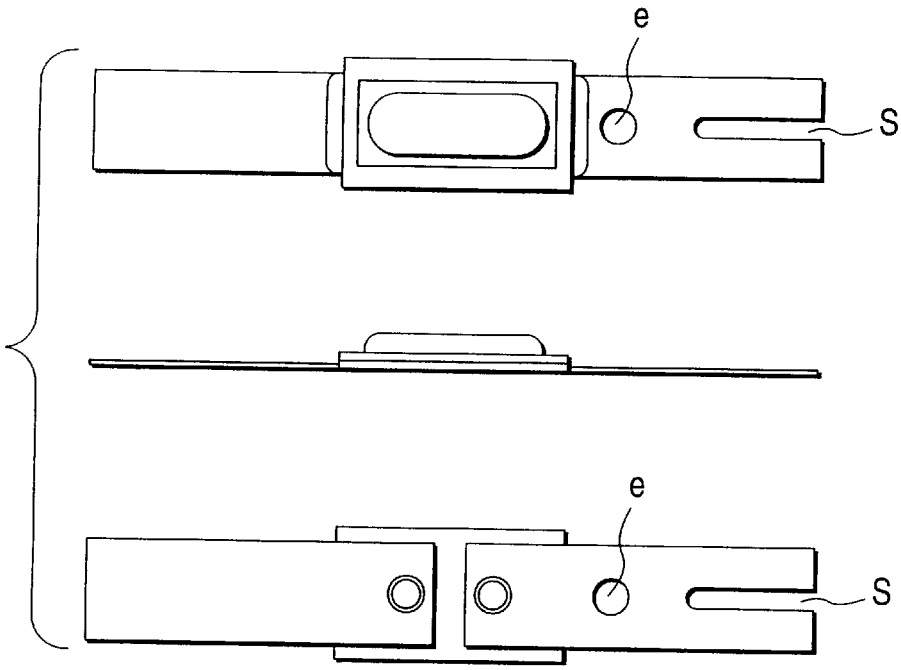
FIG. 9A and 9B are diagrams showing still more another modified embodiment of a thin type thermal fuse according to the second embodiment.
Figure 9B:
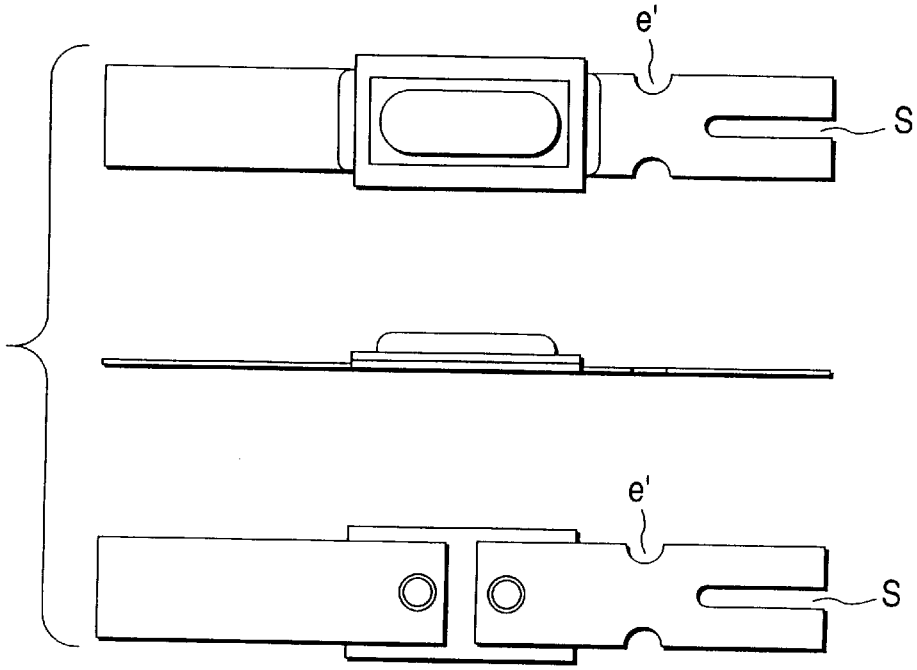

As shown in FIGS. 8A to 9B, the thin type thermal fuse according to the present invention may be arranged in a manner that a slit(s) s is provided at the end portion(s) of the belt-shaped lead conductor(s), then the electrodes are abutted against the belt-shaped lead conductor(s) so as to sandwich the slit(s) of the lead conductor(s) therebetween, and the electrodes are coupled to the coupled surface (for example, the negative electrode can of the battery) by means of the resistor welding (the slit(s) serves to set the resistance value between the electrodes at a predetermined value). Further, as shown in FIG. 9, a hole e or a notch portion e' for positioning may be provided.

As described above, according to the thin type thermal fuse fabrication method of the present invention, the thin type thermal fuse satisfying the relation of $(V/L)^{1/2}/d \leqq 1.8$ can be manufactured by the normal manufacturing method, where the distance between the tip portions of the belt-shaped lead conductors is set to be L, the volume of the low melting-point fusible alloy piece is set to be V and the distance between the surface of the resin base film and the inner surface of the resin cover film is set to be d. Even if a defective welding portion between the belt-shaped lead conductors and the low melting-point fusible alloy piece is likely caused due to the heat radiation property of the belt-shaped lead conductors, the generation ratio of the inoperative thermal fuses can be substantially made zero so long as the aforesaid relation of $(V/L)^{1/2}/d \leqq 1.8$ is satisfied. Accordingly, according to the present invention, the thin type thermal fuse superior in the operability can be manufactured easily.

What is claimed is:

1. A thin type thermal fuse comprising:

a resin base film;

a pair of belt-shaped lead conductors, tip portions of the pair of belt-shaped lead conductors being fixed on the resin base film;

a low melting-point fusible alloy piece coupled between the tip end portions of the belt-shaped lead conductors;

a flux applied on the low melting-point fusible alloy piece;

a resin cover film which is disposed on a one surface of the resin base film so that a space between said films at peripheries of both the resin cover film and the resin base film is sealed and a space between the resin cover film and the belt-shaped lead conductors is sealed;

wherein a relation of $(V/L)^{1/2}/d \leqq 1.8$ is satisfied, where a distance between the tip portions of the belt-shaped lead conductors is set to be L, a volume of the low melting-point fusible alloy piece is set to be V and a distance between a front surface of the resin base film and an inner surface of the resin cover film is set to be d.

2. The thin type thermal fuse according to claim 1, wherein the belt-shaped lead conductor comprises copper, aluminum or nickel.

3. The thin type thermal fuse according to claim 1, wherein the resin base film comprises polyethylene terephthalate, polyamide, polyimide, polybutylene terephthalate, polyphenylene oxide, polyethylene sulfide, or polysulfone.

4. The thin type thermal fuse according to claim 1, wherein the resin cover film comprises polyethylene terephthalate, polyamide, polyimide, polybutylene terephthalate, polyphenylene oxide, polyethylene sulfide, or polysulfone.

5. The thin type thermal fuse according to claim 1, wherein the tip portions of the pair of belt-shaped lead conductors are fixed on the one surface of the resin base film.

6. The thin type thermal fuse according to claim 1, wherein one of the tip portions of the pair of belt-shaped lead conductors is fixed on the one surface of the resin base film, the other of the tip portions of the pair of belt-shaped lead conductors is exposed from an other surface to the one surface of the resin base film, and the low melting-point fusible alloy piece is coupled between the exposed tip portions of the belt-shaped lead conductors.

7. The thin type thermal fuse according to claim 1, wherein the tip portions of the pair of belt-shaped lead conductors are exposed from an other surface to the one surface of the resin base film, and the low melting-point fusible alloy piece is coupled between the exposed tip portions of the belt-shaped lead conductors.

8. The thin type thermal fuse according to claim 1, wherein the resin cover film is a molded material having the relation of $(V/L)^{1/2}/d \leqq 1.8$.

9. A method of manufacturing a thin type thermal fuse comprising the steps of:

fixing tip portions of a pair of belt-shaped lead conductors on a resin base film;

coupling a low melting-point fusible alloy piece between the tip end portions of the belt-shaped lead conductors;

applying a flux on the low melting-point fusible alloy piece;

disposing a resin cover film on a one surface of the resin base film so that a space between said films at peripheries of both the resin cover film and the resin base film is sealed and a space between the resin cover film and the belt-shaped lead conductors is sealed;

wherein a relation of $(V/L)^{1/2}/d \leqq 1.8$ is satisfied, where a distance between the tip portions of the belt-shaped lead conductors is set to be L, a volume of the low melting-point fusible alloy piece is set to be V and a distance between the front surface of the resin base film and an inner surface of the resin cover film is set to be d.

10. The method according to claim 9, wherein the tip portions of the pair of belt-shaped lead conductors are fixed on the one surface of the resin base film.

11. The method according to claim 9, wherein one of the tip portions of the pair of belt-shaped lead conductors is fixed on the one surface of the resin base film, the other of the tip portions of the pair of belt-shaped lead conductors is exposed from an other surface to the one surface of the resin base film, and the low melting-point fusible alloy piece is coupled between the exposed tip portions of the belt-shaped lead conductors.

12. The method according to claim 9, wherein the tip portions of the pair of belt-shaped lead conductors are exposed from an other surface to the one surface of the resin base film, and the low melting-point fusible alloy piece is coupled between the exposed tip portions of the belt-shaped lead conductors.

13. The thin type thermal fuse according to claim 1, wherein the resin cover film has been previously molded to have the relation of $(V/L)^{1/2}/d \leqq 1.8$.

* * * * *